US006158453A

United States Patent [19]

Nasco

[11] Patent Number: 6,158,453

[45] Date of Patent: Dec. 12, 2000

[54] WHEEL MOUNTED CANE WITH BRAKE

[76] Inventor: Mike Nasco, 7842 N. Northland, Scottsdale, Ariz. 85251

[21] Appl. No.: 09/344,238

[22] Filed: Jun. 25, 1999

[51] Int. Cl.[7] ..... A45B 1/02

[52] U.S. Cl. ..... 135/85; 135/77

[58] Field of Search ..... 135/65, 66, 77, 135/85, 67

[56] References Cited

U.S. PATENT DOCUMENTS

| | | | |
|---|---|---|---|
| 5,479,953 | 1/1996 | Pasulka | 135/66 |
| 5,588,457 | 12/1996 | Tartaglia | 135/85 |
| 5,636,651 | 6/1997 | Einbinder | 135/67 |
| 5,692,533 | 12/1997 | Meltzer | 135/65 |
| 5,694,959 | 12/1997 | Hiller | 135/66 |
| 5,704,577 | 1/1998 | Gordon | 135/66 |
| 5,794,639 | 8/1998 | Einbinder | 135/67 |
| 5,938,240 | 8/1999 | Gairdner | 135/85 |
| 5,975,100 | 11/1999 | Sfeir | 135/66 |

OTHER PUBLICATIONS

Pediatric Quad Cane.

*Primary Examiner*—Beth A. Stephan

*Attorney, Agent, or Firm*—Warren F. B. Lindsley; Frank J. McGue

[57] ABSTRACT

A wheel mounted cane secured to extend laterally from a four-wheeled carriage for use in supporting and balancing a user while walking and including an adjustable braking means for the carriage.

6 Claims, 1 Drawing Sheet

13
11
10
39

21
16
25
14A
25
36
22
12
14B
23
12A
14A
19
17
2
15
18
14B
35
34
14A
34
33
32
13
10
11

16,21
24
25
24
25
23
22
28
29
33
33
33
34
14A
14B
12A
34
35
31
31
14B
23A
26
29
27
21
14B
14B
32
12A
35
33
33
35
33
33
15
27
26

37
21
14B
27
28
38
17
37
15
26

WHEEL MOUNTED CANE WITH BRAKE

BACKGROUND OF THE INVENTION

This invention relates to a cane for use by persons requiring light or moderate weight bearing support while walking or by persons having difficulty maintaining balance while standing.

An existing device currently available from TFI Healthcare under the product name "Pediatric Quad Cane" is intended to aid in maintaining support. The Quad Cane comprises a cane mounted upright upon four laterally extending legs. This device provides the support and stability required but it must be picked up and moved ahead by the user by a step-by-step procedure. This procedure may be laborious and tiring.

In accordance with the invention claimed, the four legs of the Pediatric Quad Cane are replaced by a wheel mounted support that is easily moved. Incorporated in the present device is a braking means which enables the user to stop suddenly without falling or losing balance.

DESCRIPTION OF THE PRIOR ART

The "Quad Cane" as described is believed to be the closest known prior art. Another device commonly known as a "walker" comprises a wheel-mounted frame that provides support to both arms of the users. The walker is intended for use by more seriously disabled persons and is considerably more bulky and cumbersome than the device of the present invention.

SUMMARY OF THE INVENTION

In accordance with the invention claimed, a new and improved walking aid is provided in the form of a wheel-mounted cane.

It is, therefore, one object of this invention to provide an improved walking aid in the form of a roller cane for use by persons requiring light to moderate weight bearing support or by persons having difficulty maintaining balance while walking.

Another object of this invention is to provide a cane that is grasped by one hand of the user as in the case of an ordinary walking cane during use.

A further object of this invention is to provide such a cane supported by a wheel mounted chassis or carriage.

A still further object of this invention is to provide such a rolling cane in a form which incorporates a means for adjusting the height or length of the cane.

Yet another object of this invention is to provide such a rolling cane in a form that incorporates a braking means.

Other objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figures 1, 2, 3, 4:
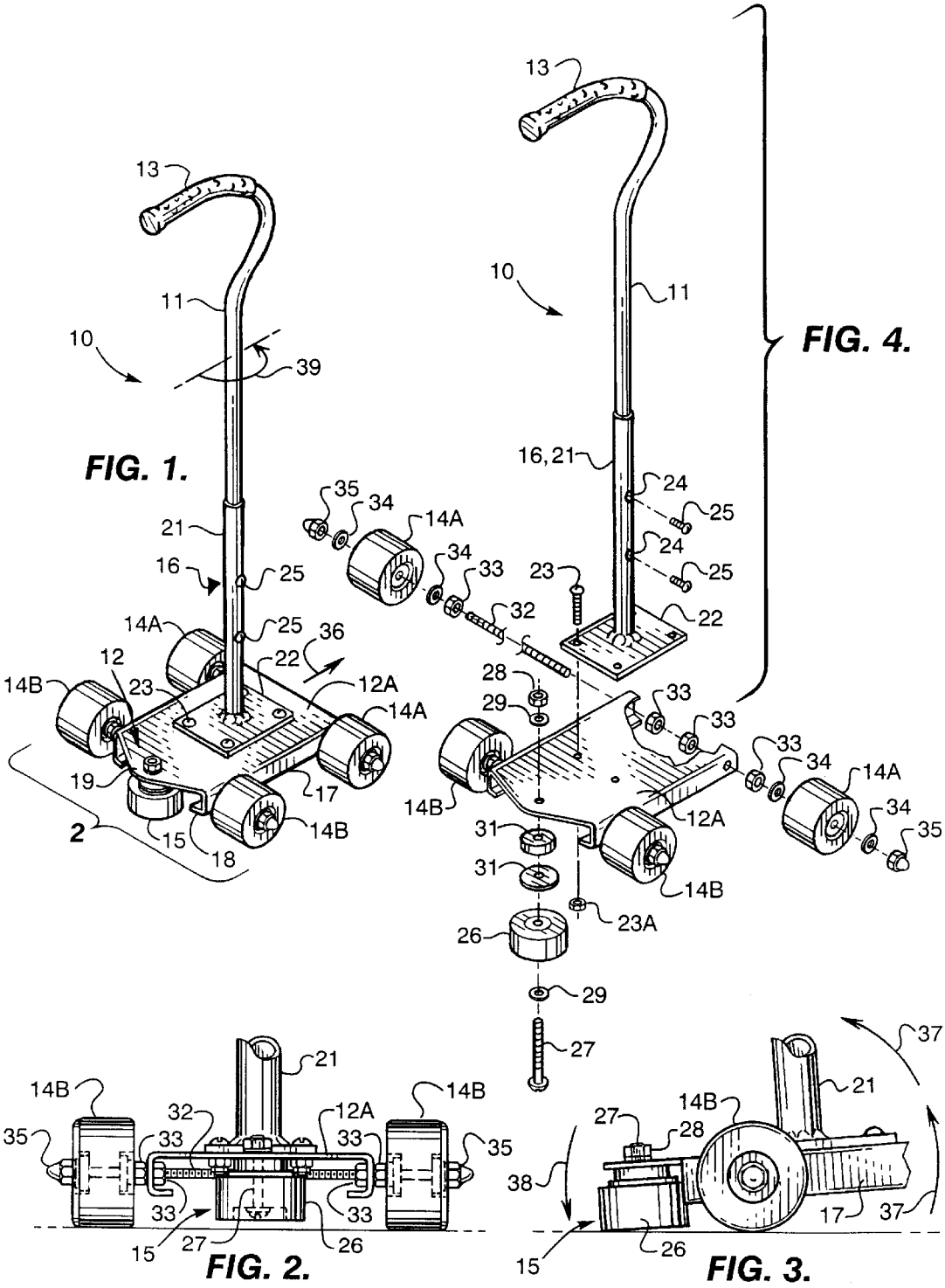
FIG. 1 is a perspective view of a preferred implementation of the rolling cane of this invention.
FIG. 2 is a partial end view of FIG. 1 showing a portion of the mobile cane referenced by bracket 2 of FIG. 1.
FIG. 3 is a partial side view of the rolling cane of the invention illustrating an adjustable braking means and its method of operation.
FIG. 4 is an exploded view of the rolling cane of FIGS. 1–3.

Referring more particularly to the drawing by characters of reference, FIGS. 1–4 disclose a rolling cane 10 of the invention wherein the rolling cane comprising a cane 11 secured in an upright position atop a carriage 12.

Cane 11 is preferably formed from tubular aluminum in the shape of an ordinary walking cane with an appropriate covering applied to a hand grip 13.

Carriage 12 comprises a generally rectangular chassis 12A with front and rear wheels 14A and 14B, respectively, positioned at its corners. An adjustable braking means 15 is secured at the rearward end of the chassis and a cane support 16 is mounted upon its top surface to extend vertically therefrom.

Chassis 12A is preferably formed from a light weight metal such as aluminum with its side edges 17 bent downwardly to provide mounting surfaces for wheels 14A and 14B and then inwardly at 18 for purposes of strength. End 19 of chassis 12A extends rearwardly beyond the rear wheels 14B to provide a mounting location for breaking means 15.

Cane support 16 comprises a cylindrical shell or sleeve 21 with one end welded at a right angle to the center of a rectangular plate 22. The plate 22 is secured to the top surface of chassis 12A by four screws 23 and associated nuts 23A. The inside diameter of shell 21 is somewhat greater than the outside diameter of cane 16 so that it slidably receives the lower end of cane 16 and rigidly holds cane 16 in an upright or vertical position. Holes 24 in the sides of shell 21 and a plurality of spaced apart holes in cane 11 permit cane 11 to be secured at adjustable heights within shell 21 with the aid of spring cips or suitable screws 25.

Alternatively, screws 25 may be set screws that thread into holes 24 in shell 21 and impinge upon cane 11.

The adjustable braking means 15 comprises a rubber bumper 26 secured to the underside of chassis 12A at the extended rearward end 19 thereof using a screw 27, nut 28, lock washers 29 and spacers 31 as needed for height adjustments (see FIG. 4). In a first embodiment of the invention, a rubber-tired wheel serves as a brake or bumper 26 adjustable to compensate for wear.

In the first embodiment of the invention, wheels 14A and 14B are mounted as shown in FIGS. 2 and 4. A threaded rod 32 which is passed through aligned holes in the bent-down sides 17 of chassis 12A is secured in position by four nuts 33, and rod 32 serving as the axle for a pair of wheels 14A or 14B. The wheels were then mounted on the extending ends of rod 32 on both sides of chassis 12A using a washer 34 on each side of each wheel and securing the wheel in place with a nut 35.

The wheels 14A and 14B are preferably equipped with soft rubber tires with built-in bearings.

The users of roller or mobile cane 10 grips the cane as he or she would hold an ordinary walking cane. In this case, however, the roller or mobile cane is pushed along in the direction of arrow 36 of FIG. 1. Because cane 11 is rigidly supported in its vertical orientation, it serves as relatively stable means of support for the user as well as a balancing aid.

In the event the user needs to stop suddenly or reduce walking speed, the braking means 15 is activated by tilting the cane backwards about its rear wheels 14B as indicated by the arrows 37 shown in FIG. 3, thereby thrusting bumper 26 against the sidewalk or pavement (arrow 38) to produce the desired braking action.

Some users may prefer to reverse the direction of travel for the rolling cane, moving it in the direction opposite that of arrows 36. Braking means 26 is then located ahead of the leading set of wheels 14B. In this case, the braking means 15 is activated by thrusting the cane forwardly. The rubber bumper 26 is driven against the sidewalk or pavement to produce the braking action.

Hand grip 13, as shown in FIGS. 1 and 4, is suitable shaped to provide a comfortable grip for either direction of travel. If the user prefers, however, the cane may be reversed by removing screws 25 or depressing associated spring clips, rotating cane 11 through 180 degrees as indicated by arrow 39 and re-installing screws 25 or associated spring clips.

Details of construction may vary without departing from the rolling cane concept. Plate 22 can be eliminated, for example, by welding the lower end of shell 21 directly to the top surface of chassis 12A; the four wheels 14A and 14B may be individually mounted rather than in pairs that have a common rod 32 or the number of wheels may be reduced to three.

Although but a few embodiments of the invention have been illustrated and described, it will be apparent to those skilled in the art that various changes and modifications may be made therein without departing from the spirit of the invention or from the scope of the appended claims.

What is claimed is:

1. A rolling cane comprising:

a carriage having a chassis with front and rear mounted wheels; and a cane with a hand grip at an upper end of the cane;

said cane being rigidly secured atop said chassis in a laterally extended position whereby when the user of said rolling cane grasps the hand grip said cane supports and balances the user while walking and pushing said cane ahead of said user;

a braking means comprising a rubber bumper secured to an underside of the chassis at a position rearwardly of the rear wheels whereby the braking means may be activated by tilting the cane backwardly about the rear wheels of the carriage, thereby causing the rubber bumper to be thrust against a surface of support to effect braking action by the rubber bumper.

2. The rolling cane set forth in claim 1 wherein:

said cane is pushed in a nominally rearward direction; and the braking means is activated by tilting said cane forwardly.

3. The rolling cane set forth in claim 1 in further combination with;

means for adjustably securing said cane atop said chassis;

said means comprising a cylindrical sleeve extending vertically outwardly from a top surface of said chassis of said carriage, a lower end of said cane slidably fitting therein and the vertical position of the cane therein being secured by means of screws passing through holes in said sleeve and through selected holes in said lower end of said cane.

4. The rolling cane set forth in claim 1 wherein:

said braking means is adjustable to serve the needs of the user and to compensate for wear of the braking means.

5. The rolling cane set forth in claim 3 wherein: said cane is adapted to rotate within said cylindrical sleeve in steps of 180 degrees.

6. The rolling cane set forth in claim 3 wherein:

said screws comprise spring clips.

* * * * *